US010964463B2

(12) United States Patent
Hayakawa et al.

(10) Patent No.: US 10,964,463 B2
(45) Date of Patent: Mar. 30, 2021

(54) ALLOY FOR R—T—B BASED RARE EARTH SINTERED MAGNET AND METHOD FOR PRODUCING THE R—T—B BASED RARE EARTH SINTERED MAGNET

(71) Applicant: TDK CORPORATION, Tokyo (JP)

(72) Inventors: Takuma Hayakawa, Tokyo (JP); Makoto Iwasaki, Tokyo (JP); Tetsuya Hidaka, Tokyo (JP); Eiji Kato, Tokyo (JP); Hidetake Kitaoka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 237 days.

(21) Appl. No.: 15/936,752

(22) Filed: Mar. 27, 2018

(65) Prior Publication Data

US 2018/0286544 A1 Oct. 4, 2018

(30) Foreign Application Priority Data

Mar. 30, 2017 (JP) ..... JP2017-069138

(51) Int. Cl.

| | |
|---|---|
| ***H01F 1/057*** | (2006.01) |
| ***H01F 41/02*** | (2006.01) |
| ***B22F 3/16*** | (2006.01) |
| ***B22F 9/04*** | (2006.01) |
| *C22C 38/00* | (2006.01) |

(52) U.S. Cl.

CPC ..... *H01F 1/0577* (2013.01); *H01F 41/0266* (2013.01); *C22C 38/005* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2009/0035170 | A1* | 2/2009 | Nakajima | B22D 11/0611 420/83 |
| 2011/0095855 | A1* | 4/2011 | Kuniyoshi | H01F 1/0577 335/302 |
| 2014/0191831 | A1 | 7/2014 | Yamazaki et al. | |

FOREIGN PATENT DOCUMENTS

| | | | |
|---|---|---|---|
| CN | 103915232 | A | 7/2014 |
| JP | 2006-210893 | A | 8/2006 |
| WO | 2005-031023 | A1 | 4/2005 |

* cited by examiner

*Primary Examiner* — Xiaowei Su

(74) *Attorney, Agent, or Firm* — Oliff PLC

(57) ABSTRACT

Provided is an alloy for R-T-B based rare earth magnet. "R" is one or more of a rare earth element, 'T' is one or more of a transition metal element essentially including Fe or Fe and Co, and "B" is boron. The alloy includes a single or a plural number of main phase (A), having a minimum length of 10 μm or more and a maximum length of 30 μm or more and 300 μm or less, in a cross section cut along a thickness direction of the alloy. The main phase (A) includes an $R_2T_{14}B$ phase, and an area ratio of the main phase (A) to an entire cross section is 2% or more and 60% or less.

14 Claims, 8 Drawing Sheets

ALLOY FOR R—T—B BASED RARE EARTH SINTERED MAGNET AND METHOD FOR PRODUCING THE R—T—B BASED RARE EARTH SINTERED MAGNET

BACKGROUND OF THE INVENTION

1. Field of the Invention

The present invention relates to an alloy for R-T-B based rare earth sintered magnet and a method for producing the R-T-B based rare earth sintered magnet.

2. Description of the Related Art

The R-T-B based rare earth sintered magnets are known to have excellent magnetic properties. At present, further improvements of magnetic properties and squareness ratio are desired. In particular, controlling abnormal grain growth is important to improve the squareness ratio.

Conventionally, the abnormal grain growth control has been carried out by controlling pulverized grain diameter by precisely controlling pulverizing conditions of a raw material alloy. However, there is a limit to precisely control the pulverizing conditions.

It was also attempted to control pulverized grain diameter by controlling the raw material alloy structure to suppress abnormal grain growth. Patent Document 1 describing control of the raw material alloy structure is exemplified. Patent Document 1 describes raw material alloy for a rare earth magnet in which at least two of M-B based compound, M-B—Cu based compound and M-C based compound (M is one or more of Ti, Zr and Hf) and R oxide in addition are dispersed and deposited in the alloy structure.

Although Patent Document 1 provides an alloy controlling abnormal grain growth, due to the existence of R oxide in the alloy, an R-rich phase as a source of coercive force is not sufficiently generated, and that coercive force of R-T-B based rare earth sintered magnet produced using the above-mentioned alloy cannot be further improved.

Patent Document 1: JP-A-2006-210893

SUMMARY OF THE INVENTION

The present invention aims to obtain an alloy for R-T-B based rare earth sintered magnet to obtain an R-T-B based rare earth sintered magnet which improves magnetic properties (Br, Hcj or Hk/Hcj) while suppressing abnormal grain growth.

To achieve the above object, the alloy for R-T-B based rare earth sintered magnet according to the present invention, in which R is one or more rare earth elements, T is one or more transition metal elements essentially including Fe or Fe and Co, and B is boron,

- the alloy includes a main phase (A), having a minimum length of 10 μm or more and a maximum length of 30 μm or more and 300 μm or less, in a cross section cut along a thickness direction of the alloy,
- the main phase (A) includes an $R_2T_{14}B$ phase, and
- an area ratio of the main phase (A) to an entire cross section is 2% or more and 60% or less.

The alloy for R-T-B based rare-earth sintered magnet according to the present invention has the above-mentioned constitution, thereby the R-T-B based rare earth sintered magnet produced by the alloy for R-T-B based rare-earth sintered magnet according to the present invention becomes excellent in magnetic properties and improves Hk/Hcj, in addition.

The alloy for the R-T-B based rare earth sintered magnet according to the invention may include voids in the cross section.

According to the alloy for the R-T-B based rare earth sintered magnet of the invention, the area ratio of a large void, having a maximum length of 5 μm or more, with respect to the entire cross section cut along a thickness direction of the alloy is larger than 0% and 0.1% or less.

According to the alloy for the R-T-B based rare earth sintered magnet of the invention, a void may not be included in the main phase (A) in the cross section cut along the thickness direction of the alloy.

According to the alloy for the R-T-B based rare earth sintered magnet, in the cross section cut along the thickness direction of the alloy, a small void, having a maximum length of less than 5 μm, may be included in the main phase (A), and a large void, having a maximum length of 5 μm or more, may not be included in the main phase (A).

In the cross section cut along the thickness direction of the alloy for the R-T-B based rare earth sintered magnet of the invention, the main phase (A) may include a specific angle main phase (A1) having an angle θ made between a direction of the maximum length and the thickness direction of the alloy for the R-T-B based rare earth sintered magnet is 0° or more and 45° or less.

According to the alloy for the R-T-B based rare earth sintered magnet of the invention, in the cross section cut along the thickness direction of the alloy for the R-T-B based rare earth sintered magnet, an area ratio of the specific angle main phase (A1) to the main phase (A) may be 50% or more.

A producing method of the R-T-B based rare earth sintered magnet of the invention includes the steps of:

- pulverizing the alloy for the R-T-B based rare earth sintered magnet according to any one of the alloy mentioned above to obtain an R-T-B based rare earth alloy powder,
- obtaining the R-T-B based rare earth magnet green compact by pressing the R-T-B based rare earth alloy powder, and
- sintering the R-T-B based rare earth magnet green compact.

The embodiments of the invention are described hereinafter.

Figure 1:
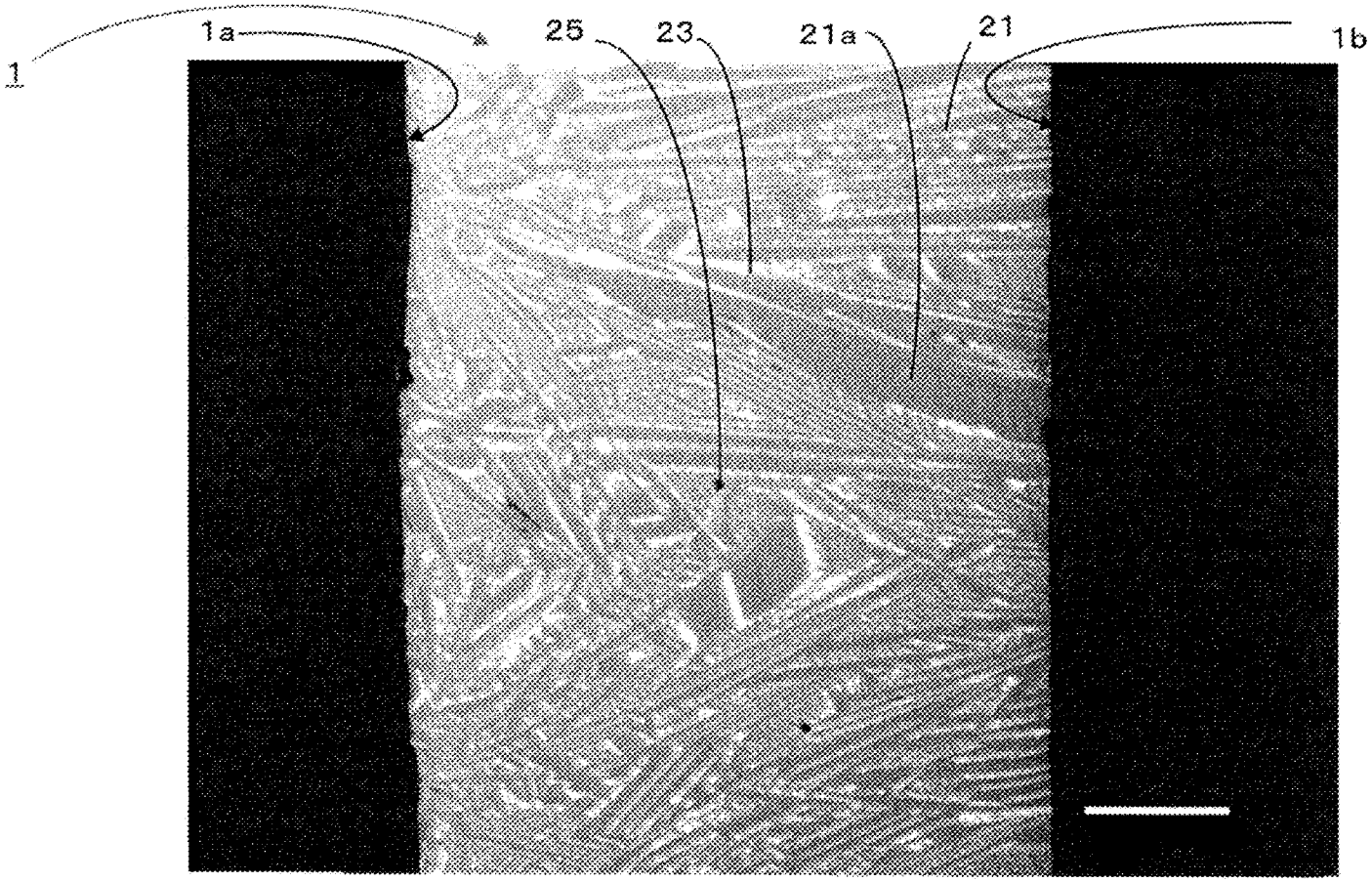
FIG. 1 is a SEM (scanning electron microscope) image of the alloy for R-T-B based rare earth sintered magnet in Example 1.

FIG. 1 is a SEM image in the cross section cut along the thickness direction of an alloy (1) for R-T-B based rare earth sintered magnet according to the embodiment. As shown in FIG. 1, the alloy (1) for R-T-B based rare earth sintered magnet according to the present embodiment includes a main phase (21) and a grain boundary phase (23).

In addition, a roll contact surface (1*a*) and an open surface (1*b*) described later are shown in the figure. The thickness direction according to the present embodiment is a direction in which roll contact surface (1*a*) and open surface (1*b*) face each other. For example, when roll contact surface (1*a*) and open surface (1*b*) are flat and parallel, the thickness direction is a direction perpendicular to both surfaces.

As shown in FIG. 1, the alloy (1) for R-T-B based rare earth sintered magnet according to the present embodiment has a single or a plural number of the main phase, having a minimum length of 10 μm or more and a maximum length of 30 μm or more and 300 μm or less. Hereinafter, the main phase is referred to as a main phase A (21*a*).

The maximum length of the main phase is the maximum distance between any two points on the outer periphery of the main phase. The minimum length of the main phase is the minimum distance between two straight lines when the main phase is sandwiched by the two straight lines, which are mutually parallel.

The main phase A(21*a*) of the alloy (1) for an R-T-B based rare earth sintered magnet according to the present embodiment includes the $R_2T_{14}B$ phase. Further, the area ratio of the entire main phase A(21*a*) to the entire cross section is 2% or more and 60% or less.

In contrast, the grain boundary phase (23) mainly includes an R rich phase. According to the R rich phase in the application, the R content is 35 mass % or more. There is no upper limit of the R content in the R rich phase, and the R-rich phase may include R only. That is, the R content may be 100 mass %.

As shown in FIG. 1, the main phase A (21*a*) is a main phase having a large elongated shape relative to the other main phase (21). Therefore, the alloy (1) for R-T-B based rare earth sintered magnet in which a single or a plural number of the main phase A (21*a*) is mixed in the other main phases (21) is considered a non-uniform alloy. However, the present inventors found that, by using such non-uniform alloy (1) for R-T-B based rare earth sintered magnet, it is possible to appropriately control pulverized grain diameter, to suppress generation of abnormal grain growth in the finally obtained R-T-B based rare earth sintered magnet, and to improve magnetic properties Br, Hcj or Hk/Hcj) thereof.

On the contrary, when an alloy not having the main phase A(21*a*) or an alloy having excessively small cross sectional area of the main phase A(21*a*) is used, it becomes difficult to suppress generation of abnormal grain growth during sintering, and Hk/Hcj of the finally obtained R-T-B based rare earth sintered magnet tends to decrease. If an alloy having the main phase (21) having the maximum length larger than that of the main phase A (21*a*) or an alloy having excessively large cross-sectional area of the main phase A is used, distribution of the grain boundary phase (23) of an R-rich phase becomes ununiform, and Hcj of the finally obtained R-T-B based rare earth sintered magnet tends to decrease.

As shown in FIG. 1, void (25) may exist in the alloy (1) for R-T-B based rare earth sintered magnet according to the present embodiment.

Further, area ratio of voids having a maximum length of 5 μm or more with respect to the entire cross section may be greater than 0% and 0.1% or less.

Further, voids do not have to be present inside the main phase A(21*a*). In addition, inside the main phase A(21*a*), voids having a maximum length of less than 5 μm may be present and voids having a maximum length of 5 μm or more do not need to be present.

In the case where there is no void inside the main phase A(21*a*) or only voids having a maximum length of less than 5 μm are present, Hk/Hcj of the finally obtained R-T-B based rare earth sintered magnet can be improved. Corrosion resistance of the finally obtained R-T-B based rare earth sintered magnet can be also improved.

Voids having a maximum length of 5 μm or more are few in the alloy (1) for R-T-B based rare earth sintered magnet, and the voids having the maximum length of 5 μm or more in the main phase A(21*a*) are particularly few. Thus, it becomes easy to control kurtosis and skewness of the grain diameter of the obtained fine powder after pulverized, within a suitable range. Specifically, the kurtosis of the grain diameter of the fine powder is preferably −1.0 or more. The skewness of the grain diameter of the fine powder is preferably −1.5 or more and 1.5 or less.

Conversely, if there are many voids having a maximum length of 5 μm or more, distribution of grain diameter of the fine powder obtained by pulverization greatly changes. In particular, when voids having the maximum length of 5 μm or more are present in the main phase A(21*a*), effect of changing distribution of the grain diameter of the fine powder becomes large.

Figure 6:
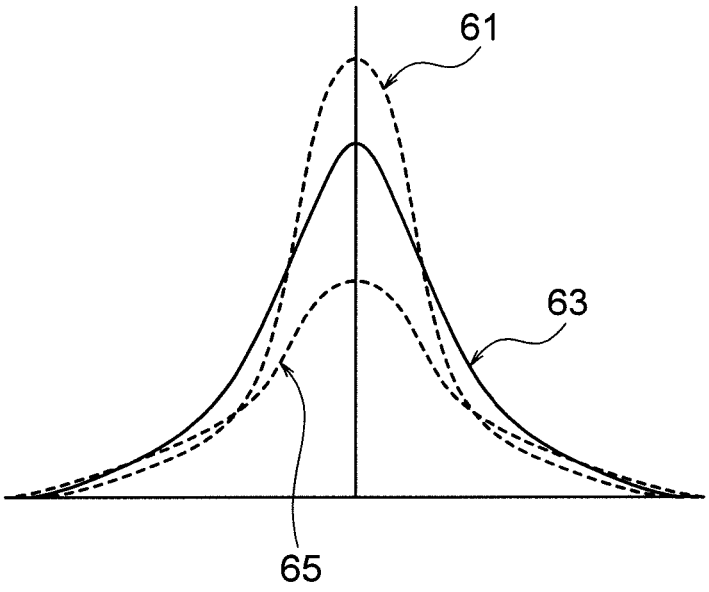
FIG. 6 is a graph describing kurtosis.

Here, kurtosis is a measure for measuring sharpness and divergent shapes of the peaks according to the distribution of data. In FIG. 6, distribution curves (61, 63, 65) with varying kurtosis are described. In order from the largest kurtosis, distribution curve (61), distribution curve (63), distribution curve (65) are obtained. As shown in FIG. 6, as kurtosis increases, sharpness of the peaks in the distribution curve are larger and the divergent shapes are smaller. The smaller the kurtosis, the smaller the sharpness of the peaks in distribution curve and the larger the divergent shapes. Note that the kurtosis of the normal distribution is zero.

Kurtosis is obtained by the following equation 1. "n" is the sample size, "x" is the average of each data $x_i$ (i=1, 2, . . . n) and "s" is standard deviation.

Formula 1

$$\frac{n(n+1)}{(n-1)(n-2)(n-3)}\sum_{i=1}^{n}\frac{(x_i-x)^4}{s^4}-\frac{3(n-1)^2}{(n-2)(n-3)} \quad \text{(Formula 1)}$$

Figure 7:
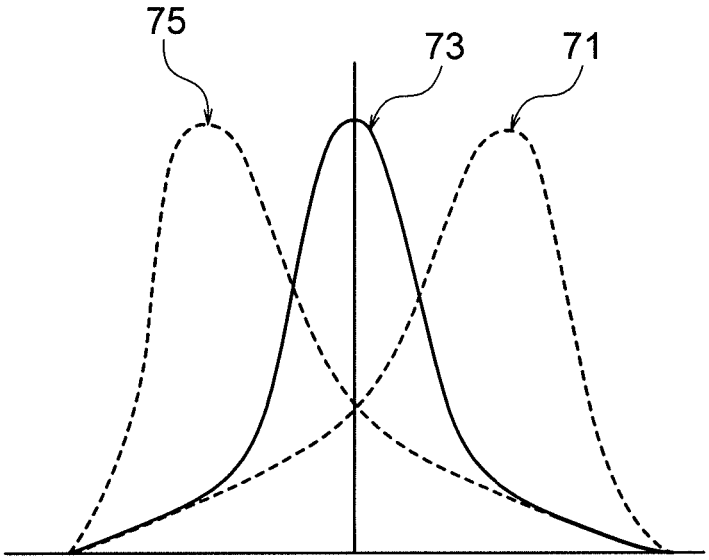
FIG. 7 is a graph describing skewness.

In addition, skewness is a measure for measuring left-right asymmetry property of data distribution. In FIG. 7, the distribution curves (71, 73, 75) with varied skewness are described. Distribution curve (71) has a negative skewness value, distribution curve (73) has a skewness of zero, and distribution curve (75) has a positive skewness value. As shown in FIG. 7, when skewness is a negative value, the peak shifts to the right and the divergent shape shifts to the left. When the skewness is a positive value, the peak shifts to the left and the divergent shape shifts to the right. Also, as the absolute value of the skewness increases, the peak and the divergent shape of the distribution curve increases. Note that skewness is zero in normal distribution.

Skewness is obtained by the following Formula 2. "n" is the sample size, "x" is the average of each data $x_i$ (i=1, 2, . . . n) and "s" is standard deviation.

Formula 2

$$\frac{n}{(n-1)(n-2)}\sum_{i=1}^{n}\frac{(x_i-x)^3}{s^3} \quad \text{(Formula 2)}$$

R-T-B based rare earth sintered magnet is produced by using a fine powder having kurtosis and skewness of the grain diameter within the above-mentioned preferable range. Thus, magnetic properties (Br, Hcj or Hk/Hcj), particularly Hk/Hcj, of the finally obtained R-T-B based rare earth sintered magnet can be improved.

Figure 5:
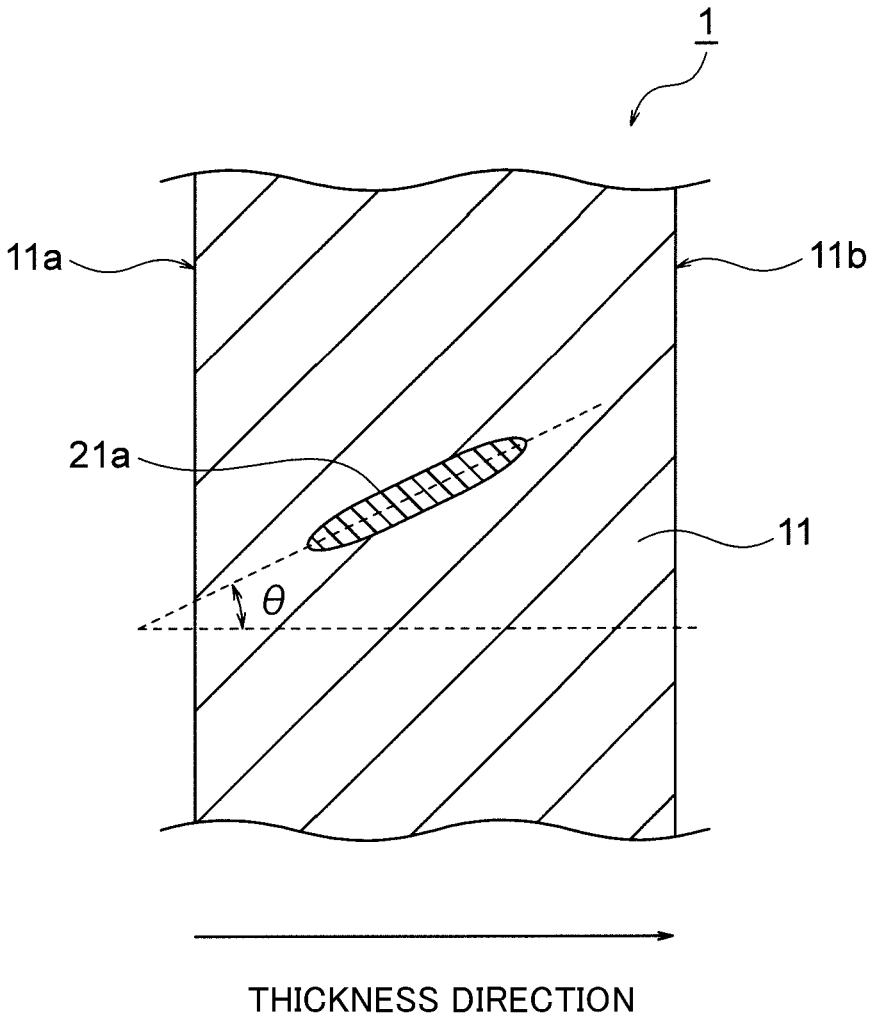
FIG. 5 is a schematic diagram showing an angle θ formed by the direction of the maximum length of the main phase A and the thickness direction of the alloy for R-T-B based rare earth sintered magnet.

As shown in FIG. 5, the plural number of the main phase A(21*a*) may be partly a single or a plural number of the specific angle main phase A1, having an angle θ between a direction of the maximum length of the main phase A(21*a*) and the thickness direction of the alloy (1) for R-T-B based rare earth sintered magnet of 0° or more and 45° or less. Specifically, the angle θ is "0" shown in FIG. 5. The dotted line passing through the main phase A(21*a*) in FIG. 5 is the direction of the maximum length of the main phase A(21*a*).

Further, the area ratio of the specific angle main phase A1 to the main phase A may be 50% or more. When the area ratio of the specific angle main phase A1 is 50% or more, the crystal orientation degree of R-T-B based rare earth sintered magnet obtained after sintering can be improved, and Br of the finally obtained R-T-B based rare earth sintered magnet can be improved. Further, transverse strength can be improved.

The alloy for R-T-B based rare-earth sintered magnet according to the present embodiment includes the main phase including $R_2T_{14}B$ crystal. "R" and "T" are not particularly limited. For example, "R" may be one or more rare earth elements and "T" may be one or more transition metal elements essentially including Fe or Fe and Co. B is boron and B may be partly substituted with carbon.

"R" is not particularly limited, but may be Nd or Nd and Pr.

The R content may be 25 mass % or more and 50 mass % or less, and may be 25 mass % or more and 40 mass % or less.

The B content in the alloy for R-T-B based rare earth sintered magnet according to the present embodiment may be 0.5 mass % or more and 2 mass % or less, preferably 0.8 mass % or more and 1.1 mass % or less.

The Co content included as "T" may be 0.5 mass % or more and 60 mass % or less. Also, the Fe content included as "T" may be a substantial balance. A transition metal element other than Fe or Fe and Co may be included.

The alloy for R-T-B based rare earth sintered magnet may further include one or more selected from Al, Cu or Zr.

The alloy for R-T-B based rare earth sintered magnet may include inevitable impurities in an amount of approximately 0.001 mass % or more and 0.5% mass % or less.

<Method for Producing an Alloy for R-T-B Based Rare Earth Sintered Magnet>

Next, a method for producing the alloy for R-T-B based rare-earth sintered magnet according to the present embodiment will be described, but the method for producing the alloy for R-T-B based rare earth sintered magnet is not limited thereto.

Hereinafter, a method for producing by a strip cast method will be described.

First, a raw material metal is prepared. A kind of the raw material metal is not particularly limited, and it may be selected to finally obtain an alloy having a composition in object.

Next, the raw material metal is heated and dissolved to obtain a molten alloy. The method of heating is not particularly limited, and for instance, a high-frequency melting may be performed. When an alloy melting temperature is Tm (° C.), it is preferable to heat at (Tm+150) ° C. or more and (Tm+250) ° C. or less during the heating. The alloy melting temperature Tm (° C.) varies depending on the composition of the finally obtained R-T-B based rare earth sintered magnet alloy, but it is for example, 1150° C. or more and 1350° C. or less. The atmosphere during the high-frequency melting is not particularly limited, and an inert gas atmosphere such as an argon atmosphere is exemplified.

The lower the heating temperature, the easier the area per one main phase is likely to be large. The higher the heating temperature, the easier the area per one main phase is likely to be small.

Next, the molten alloy is poured into a cooling roll via a tundish. In this case, it is preferable to control the temperature, the rotation speed, etc. of the cooling roll, so that the temperature of an alloy slab detached from the cooling roll becomes 500° C. or more and 700° C. or less. As the temperature of the alloy slab becomes higher, the main phase A is more likely to be generated, but when the temperature is too high, it becomes difficult to suppress the generation of the main phase larger than the main phase A.

Next, the alloy slab is collected by a collecting part. The collected alloy slab is kept at a temperature controlled collecting part for a specific time. Thereafter, by cooling the collecting part, it is possible to obtain a ribbon-shaped alloy of the alloy for R-T-B based rare earth sintered magnet (hereinafter, referred to as an alloy ribbon). The atmosphere during a series of cooling is not particularly limited, and an inert gas atmosphere such as an argon atmosphere is exemplified.

The thickness of the alloy ribbon is not particularly limited, but it is preferably 100 μm or more and 500 μm or less. The thickness of the alloy ribbon can be adjusted by the pouring amount of the molten alloy, the width of tundish, etc.

Temperature of the collecting part is not particularly limited, but it is preferably 700° C. or more and 800° C. or less. The higher the temperature of the collecting part is, the easier it is to suppress the generation of voids. The lower the temperature of the collecting part is, the easier it is to suppress the generation of the main phase larger than the main phase A.

Figure 2:
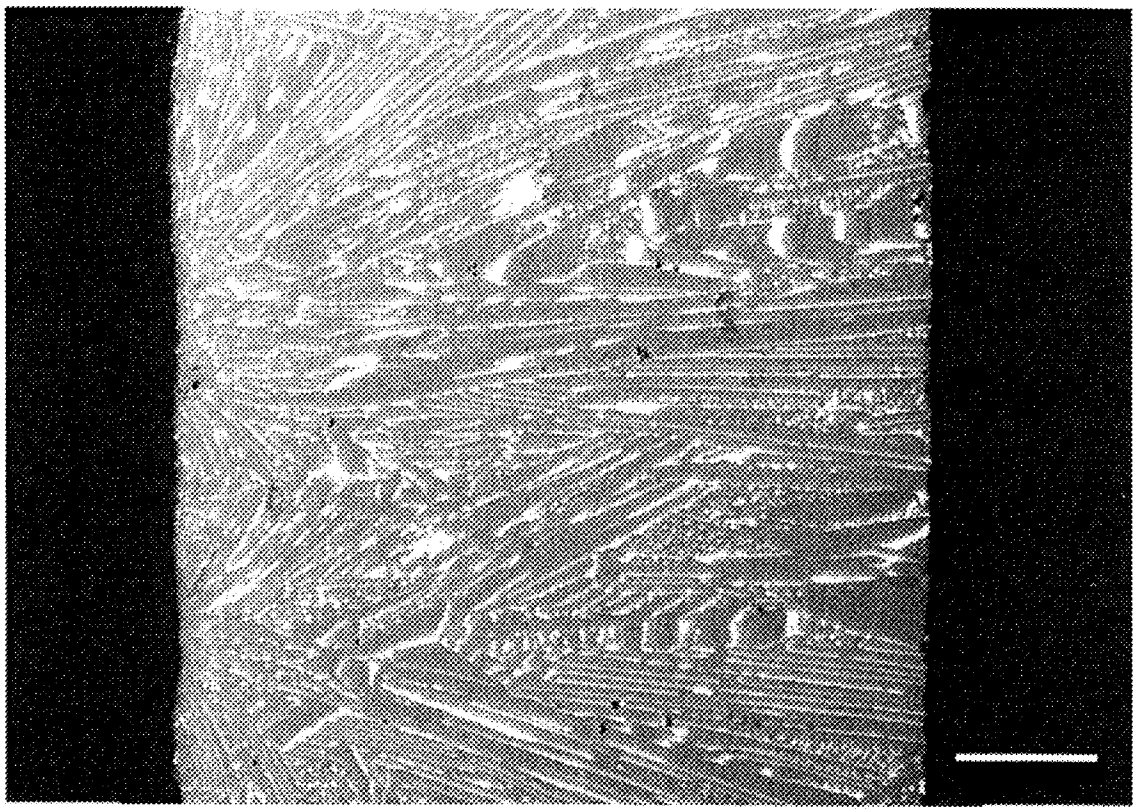
FIG. 2 is a SEM image of the alloy for R-T-B based rare earth sintered magnet in Example 2.
Figure 3:
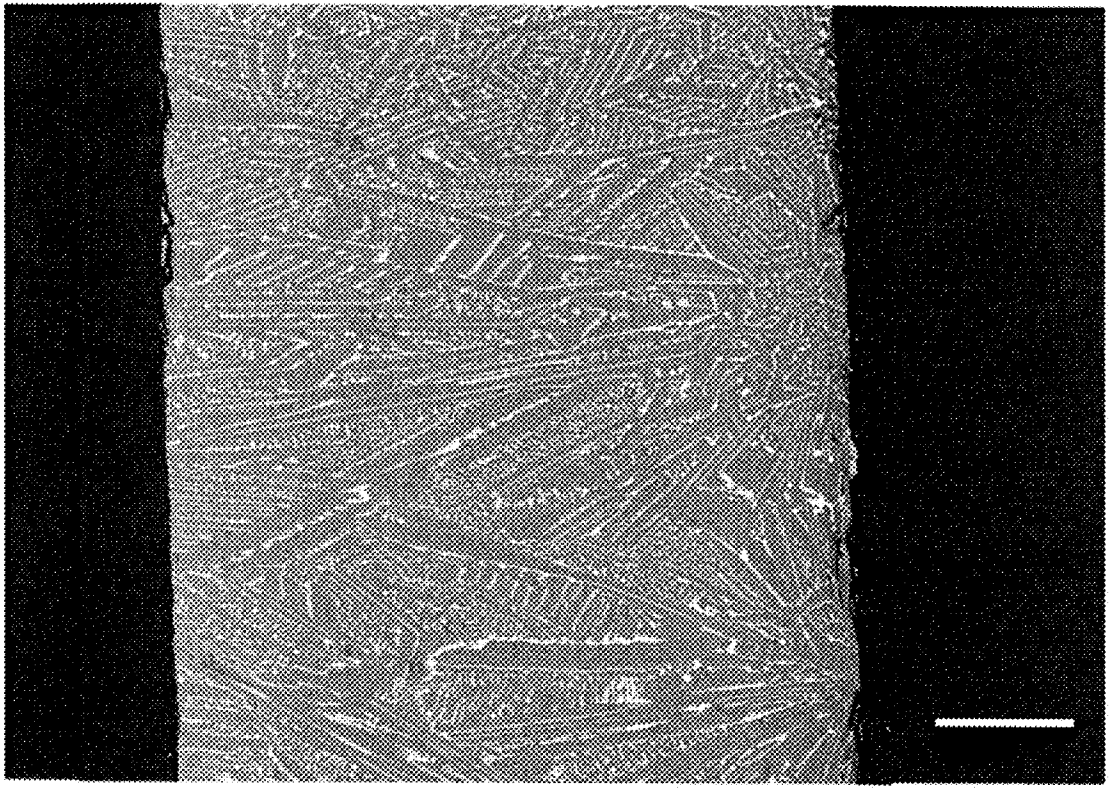
FIG. 3 is a SEM image of the alloy for R-T-B based rare earth sintered magnet in Example 3.

The holding time is not particularly limited, but it is preferably five minutes or more and 30 minutes or less. The longer the holding time, the easier it is to suppress the generation of voids. The shorter the holding time, the easier it is to suppress the generation of the main phase larger than main phase A. It is considered that the atmosphere gas, that was taken into the alloy during melting and cooling, is partly not able to escape from the alloy and forms void Cross section observation of the alloy for R-T-B based rare earth sintered magnet of the present embodiment is performed by the following. In a cross section cut along the thickness direction of the obtained alloy for R-T-B based rare earth sintered magnet, a measurement region with an area of 100 μm×100 μm or more and 1000 μm×1000 μm or less was observed by SEM. As shown in FIGS. 1 to 3, thickness of the alloy ribbon may be less than the length of one side of the measurement region in some cases.

In the finally obtained alloy for R-T-B based rare earth sintered magnet, among the two surfaces in the thickness direction, the side in contact with the cooling roll is roll contact surface (1*a*), and the side that was not in contact with the cooling roll is open surface (1*b*). Here, roll contact surface (1*a*) is rapidly cooled as compared with open surface (1*b*). Therefore, it is considered that the main phase A tends to become thinner on the side of roll contact surface (1*a*), and the side of open surface (1*b*) tends to become wider. It is considered that the alloy for R-T-B based rare earth sintered magnet tends to become non-uniform.

<Method for producing R-T-B Based Rare Earth Sintered Magnet>

Next, a method for producing R-T-B based rare earth sintered magnet according to the present embodiment will be described, but the method for producing R-T-B based rare earth sintered magnet is not limited thereto.

[Pulverization Process]

First, the produced alloy for R-T-B based rare earth sintered magnet is pulverized and an alloy powder of R-T-B based rare earth is obtained(pulverization process). The pulverization process may be carried out in two stages or in one stage. Method of the pulverization is not particularly limited. For example, it is carried out by a method using various pulverizers. For example, the pulverization step is carried out in two stages of a coarse pulverization process and a fine pulverization process, and such as a hydrogen pulverization treatment can be carried out as the coarse pulverization step. Specifically, it is possible to perform dehydrogenation at 300° C. or more to 700° C. or less for 30 minutes or more to 10 hours or less in an Ar gas atmosphere after the raw material alloy absorbs hydrogen at room temperature.

The fine pulverization process can be carried out by adding oleic acid amide, stearic acid zinc, etc. to the powder after the coarse pulverization, using jet mill, ball mill, vibration mill, etc. The grain diameter of the obtained fine pulverization powder (raw material powder) is not particularly limited. For example, it can be finely pulverized to make a finely pulverized powder (raw material powder) having a grain diameter (D50) of 1 μm or more to 10 μm or less.

[Compacting Process]

In the compacting process, the finely pulverized powder (raw material powder) obtained by the pulverization process is pressed into a predetermined shape, and a green compact of the R-T-B based rare earth magnet is obtained. The compacting process is not particularly limited. According to the present embodiment, the finely pulverized powder (raw material powder) is filled in a press mold and pressed in a magnetic field.

Pressure during pressing is preferably performed at 70 MPa or more and 200 MPa or less. The applied magnetic field is preferably 900 kA/m or more. Shape of the green compact obtained by pressing the finely pulverized powder (raw material powder) is not particularly limited, and it can have an arbitrary shape depending on a desired R-T-B based sintered magnet, such as a rectangular parallelepiped, a flat plate, a column, etc.

[Sintering Process]

Sintering process is a process of sintering the green compact in a vacuum or an inert gas atmosphere to obtain a sintered body. The sintering temperature needs to be adjusted according to various conditions, such as a composition, a pulverization method, a grain diameter and a grain diameter distribution, etc. However, the green compact is sintered at 900° C. or more and 1200° C. or less for one hour or more and 10 hours or less in vacuum or in the presence of an inert gas. Then, a high density sintered body (sintered magnet) can be obtained.

[Aging heProcess]

Aging process is carried out by heating the sintered body (sintered magnet) after the sintering process at a temperature lower than the sintering temperature. The temperature and time of the aging is not particularly limited, but it can be carried out, for example, at 600° C. or more and 900° C. or less for 0.5 hour or more and 3 hours or less.

Further, the aging process may be carried out in one stage or in two stages. Also, the aging process may be omitted. In the case where the aging process is carried out in two stages, for example, the first stage is set to 700° C. or more and 900° C. or less for 0.5 hour or more and three hours or less, the second stage is set to 500° C. or more and 700° C. or less for 0.5 hour or more and three hours or less. Further, the first stage and the second stage may be carried out continuously, or after the first stage, the second stage may be performed by once cooling to around room temperature and reheating.

R-T-B based sintered magnet obtained by the above processes may be subjected to surface treatment such as plating, resin coating, oxidation treatment or chemical conversion treatment. As a result, the corrosion resistance can be further improved.

EXAMPLES

Hereinafter, the invention will be described in detail referring to concrete examples; however, the invention is not limited thereto.

According to the present examples, alloys of each example and comparative example were obtained by strip casting method. Specific methods are described below.

Nd, electrolytic iron and low carbon ferroboron alloy were prepared as raw material metals. Then, each raw material metal was weighed so that a mother alloy having a composition of Nd: 32.0 mass %, B: 1.0 mass % and the balance being Fe was obtained. Then, high-frequency melting was performed in an alumina crucible. During high-frequency melting, making the alloy melting temperature as Tm, a molten alloy was obtained by heating and melting at the high-frequency melting temperatures shown in Table 1. Although the alloy melting temperature Tm varies in each example and the comparative example, the alloy melting temperature Tm was within the range of 1150° C. or more and 1350° C. or less in all the examples and the comparative examples. In the present example, it was specified by performing radiation thermometer measurement during the high-frequency melting.

Next, the molten alloy was poured into a cooling roll via a tundish. During this time, temperature, rotation speed, etc. of the cooling roll were controlled, so that the temperature of an alloy slab detached from the cooling roll becomes the temperature shown in Table 1. Experimental conditions were the same in Examples 1 to 3 and Experimental results varied under the same experimental conditions.

Next, the temperature of a collecting part, collecting the alloy slab, was controlled to be the temperature shown in Table 1. Then, the alloy slab was held in the collecting part for the holding time shown in Table 1. Subsequently, inert gas was introduced into the collecting part, and cooled to obtain an alloy ribbon (alloy for R-T-B based rare earth sintered magnet) having a thickness of around 250 μm.

TABLE 1

| | High frequency heating temperatures (° C.) | Temperature of an alloy slab detached from the cooling roll (° C.) | Temperature of an collecting part (° C.) | Retaining time at collecting part (min) |
|---|---|---|---|---|
| Ex. 1 | Tm + 200 | 600 | 700 | 15 |
| Ex. 2 | Tm + 200 | 600 | 700 | 15 |
| Ex. 3 | Tm + 200 | 600 | 700 | 15 |
| Ex. 4 | Tm + 200 | 700 | 700 | 30 |
| Ex. 5 | Tm + 250 | 650 | 800 | 5 |
| Ex. 6 | Tm + 250 | 600 | 700 | 30 |
| Ex. 7 | Tm + 150 | 550 | 800 | 30 |
| Ex. 8 | Tm + 150 | 500 | 600 | 0 |
| Ex. 9 | Tm + 200 | 550 | 600 | 5 |
| Ex. 10 | Tm + 250 | 600 | 800 | 5 |
| Comp. Ex. 1 | Tm + 300 | 750 | 700 | 15 |
| Comp. Ex. 2 | Tm + 250 | 750 | 700 | 30 |
| Comp. Ex. 3 | Tm + 200 | 450 | 800 | 40 |
| Comp. Ex. 4 | Tm + 300 | 700 | 600 | 5 |
| Comp. Ex. 5 | Tm + 100 | 500 | 900 | 30 |

The alloy ribbon thus obtained was cut along the thickness direction. With respect to the cross sections of Examples. 1 to 3, the measurement region of 270 μm×400 μm was observed using SEM, and the results are shown in FIGS. 1 to 3. As shown in FIGS. 1 to 3, the thickness of the alloy ribbon may be less than 230 μm. The scale bar in FIGS. 1 to 3 are 50 μm.

Figure 4:
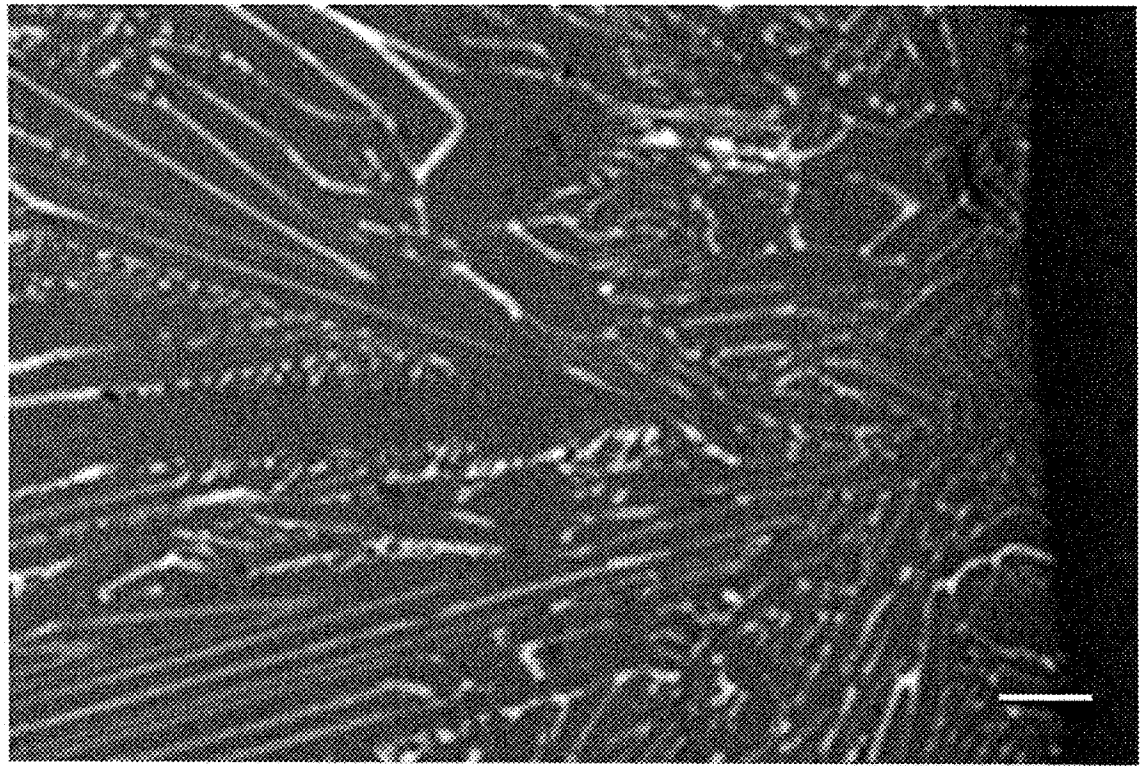
FIG. 4 is a SEM image of the alloy for R-T-B based rare earth sintered magnet in Example 4.

Further, SEM image of FIG. 4 is a cross section of Example 4, observed by SEM. Unlike FIGS. 1 to 3, the SEM image of FIG. 4 is observed near the roll contact surface. In Example 4, it can be confirmed that voids exist in the grain boundary and do not exist inside the main phase. The scale bar in FIG. 4 is 10 μm.

Table 2 shows the maximum value of the minimum length, the minimum value of the maximum length, and the maximum value of the maximum length according to the main phase in each example and comparative example. The main phase A does not exist when the maximum value of the minimum length is less than 10 μm, when the minimum value of the maximum length exceeds 300 μm or when the maximum value of the maximum length is less than 30 μm. The minimum value of the maximum length is the minimum value among the main phases having the maximum length of 30 μm or more. When there is no main phase having the maximum length of 30 μm or more, the minimum value of the maximum length is written "absent".

Furthermore, presence or absence of the main phase A, presence or absence of voids, presence or absence of voids in the main phase A, the maximum length of voids in the main phase A, and presence or absence of the specific angle main phase A1 were visually observed by SEM image. The area ratio of the main phase A, the area ratio of the voids having the maximum length of 5 μm or more, and the area ratio of the specific angle main phase A1 were calculated by SEM image. Results are shown in Table 2.

Further, in all Examples and Comparative Examples in which the main phase A exists, it was confirmed that the main phase A includes the $R_2T_{14}B$ phase and the grain boundary phase includes the R-rich phase by a contrast of the backscattered electron image of SEM and EDS (Energy Dispersive X-ray Spectroscopy).

In Example 6, it was confirmed that the void having the maximum length of 5 μm or more was present, but the area ratio was less than 0.01%, by visual observation of SEM image.

TABLE 2

| | Maximum value of minimum diameter (μm) of main phase | Minimum value of maximum diameter (μm) of main phase | Maximum value of maximum diameter (μm) of main phase | Presence or absence of main phase | Area ratio (%) of main phase | Presence or absence of void |
|---|---|---|---|---|---|---|
| Ex. 1 | 13 | 43 | 268 | present | 14 | present |
| Ex. 2 | 20 | 33 | 138 | present | 28 | present |
| Ex. 3 | 37 | 40 | 190 | present | 7 | present |
| Ex. 4 | 15 | 34 | 150 | present | 13 | present |
| Ex. 5 | 53 | 77 | 176 | present | 41 | present |
| Ex. 6 | 43 | 35 | 120 | present | 2 | present |
| Ex. 7 | 38 | 42 | 224 | present | 60 | present |
| Ex. 8 | 21 | 52 | 180 | present | 35 | present |
| Ex. 9 | 21 | 47 | 231 | present | 21 | present |
| Ex. 10 | 33 | 52 | 170 | present | 32 | present |
| Comp. Ex. 1 | 8 | 53 | 267 | absent | 0 | present |
| Comp. Ex. 2 | 13 | absent | 27 | absent | 0 | present |
| Comp. Ex. 3 | 24 | 326 | 326 | absent | 0 | present |
| Comp. Ex. 4 | 12 | 93 | 93 | present | 1 | present |
| Comp. Ex. 5 | 64 | 148 | 280 | present | 72 | present |

| | Area ratio (%) of voids having the maximum diameter of 5 μm or more | Presence or absence of void in main phase | Maximum diameter of void (μm) in main phase | Presence or absence of specific angle in main phase A1 | Area ratio (%) of specific angle main phase A1 |
|---|---|---|---|---|---|
| Ex. 1 | 0.05 | absent | 0 | present | 92 |
| Ex. 2 | 0.03 | absent | 0 | present | 73 |
| Ex. 3 | 0.01 | absent | 0 | present | 59 |
| Ex. 4 | 0.09 | absent | 0 | present | 86 |
| Ex. 5 | 0.07 | present | 3 | present | 78 |
| Ex. 6 | <0.01 | absent | 0 | present | 92 |
| Ex. 7 | 0.02 | absent | 0 | present | 50 |
| Ex. 8 | 0.28 | present | 2 | present | 70 |

TABLE 2-continued

| | | | | | |
|---|---|---|---|---|---|
| Ex. 9 | 0.09 | present | 7 | present | 82 |
| Ex. 10 | 0.07 | present | 3 | present | 45 |
| Comp. Ex. 1 | 0.07 | absent | 0 | present | 67 |
| Comp. Ex. 2 | 0.04 | absent | 0 | present | 80 |
| Comp. Ex. 3 | 0.07 | absent | 0 | present | 62 |
| Comp. Ex. 4 | 0.09 | present | 2 | present | 55 |
| Comp. Ex. 5 | 0.06 | absent | 0 | present | 63 |

Next, hydrogen was absorbed to the obtained alloy ribbon by a hydrogen gas flow at a room temperature for one hour. Subsequently, the atmosphere was changed to Ar gas, dehydrogenation was carried out at 500° C. for one hour, and the alloy ribbon was hydrogen-pulverized.

Subsequently, 1.5 wt % of oleic acid amide was added as a pulverization aid to the powder after hydrogen pulverization, and mixed thereof.

Figure 8:
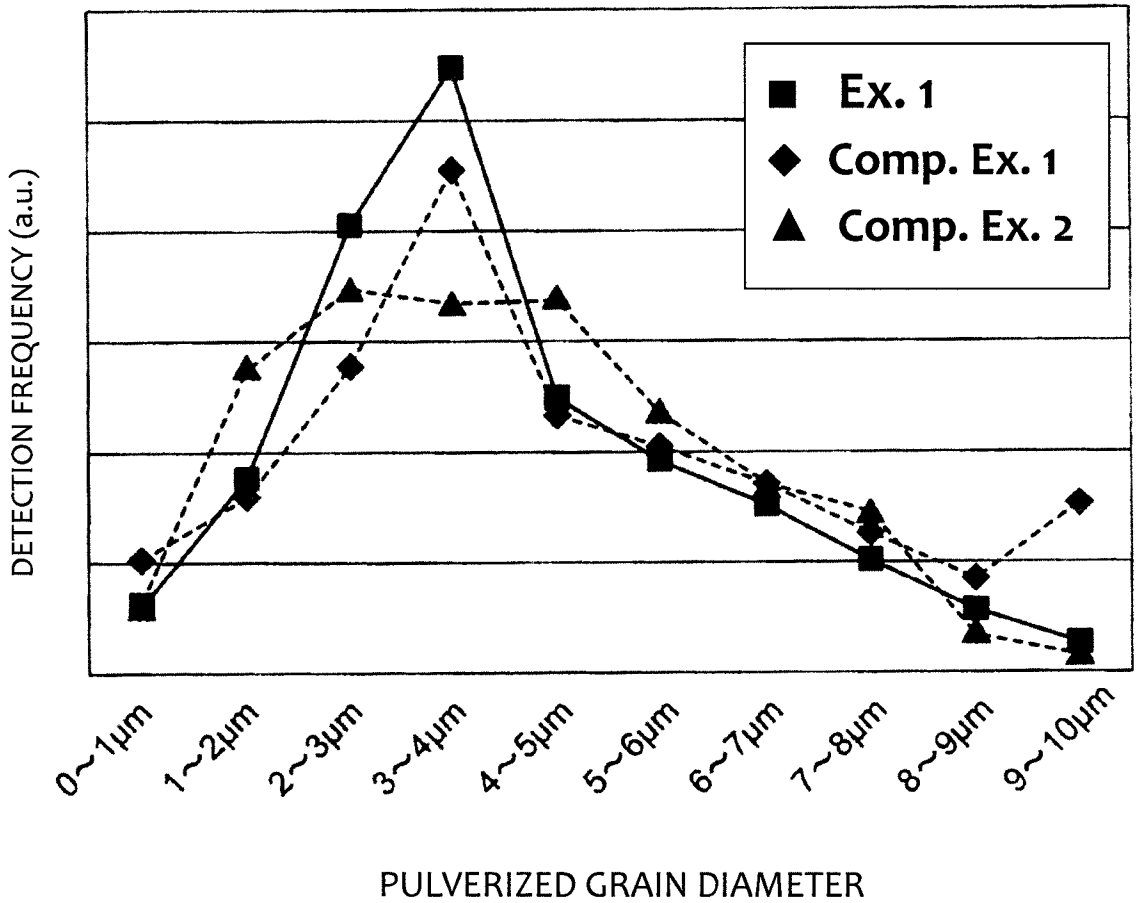
FIG. 8 is a graph showing a relationship between pulverized grain diameter and detection frequency in volume of grains of each pulverized grain diameter.

Next, fine pulverization was carried out in nitrogen stream using a collision plate type jet mill device to obtain fine powder. Then, kurtosis and skewness of the fine powder were measured. Kurtosis and skewness of the fine powder were calculated by measuring the grain diameter distribution by a laser diffraction type grain diameter distribution meter. Results are shown in Table 3. Also, according to Example 1, Comparative Example 1 and Comparative Example 2, a graph, in which the horizontal axis represents the pulverized grain diameter of the fine powder and the vertical axis represents detection frequency in volume of each fine powder, is shown in FIG. 8. The frequency is the volume frequency.

FIG. 8 visually describes high kurtosis and skewness of Comparative Example 1 relative to those of Example 1. In addition, FIG. 8 visually describes low kurtosis and skewness of Comparative Example 2, relative to those of Example 1.

The obtained fine powder was pressed in a magnetic field to prepare a green compact. The applied magnetic field is a static magnetic field of 1200 kA/m. In addition, the pressure applied during pressing was 120 MPa. In addition, the applied magnetic field direction and the pressured direction were orthogonal. Density of the green compact was measured at this point, and densities of all the green compacts were within the range of 4.10 $Mg/m^3$ or more and 4.25 $Mg/m^3$ or less.

Next, the green compact was sintered, and a sintered magnet was obtained. Sintering conditions were held at 1020° C. for two hours. The sintering atmosphere was a vacuum. The sintered density was 7.50 $Mg/m^3$ or more and 7.55 $Mg/m^3$ or less. Further, the shape of the sintered magnet was a rectangular parallelepiped shape of 10 mm×10 mm×11 mm. Subsequently, in Ar atmosphere under atmospheric pressure, the first aging was performed at a first aging temperature T1 of 800° C. for two hours, and a second aging was performed at a second aging temperature T2 of 500° C. for two hours.

According to the obtained sintered magnet, presence or absence of abnormal grain growth was observed. The presence or absence of abnormal grain growth was carried out by observing a cross section of the sintered magnet using SEM. In addition, Br, Hcj and Hk/Hcj were evaluated by BH tracer. Results are shown in Table 3. In this example, the Br of 1410 mT or more was determined preferable, and 1420 mT or more was determined further preferable. Hcj of 1150 kA/m or more was determined preferable. The Hk/Hcj of 95% or more was determined preferable, and 97% or more was determined further preferable.

TABLE 3

| | Kurtosis of fine powder | Skewness of fine powder | Presence or absence of abnormal grain growth | Br (mT) | Hcj (kA/m) | squareness ratio (%) |
|---|---|---|---|---|---|---|
| Ex. 1 | 0.52 | 1.25 | absent | 1424 | 1169 | 97 |
| Ex. 2 | 1.77 | 1.32 | absent | 1430 | 1163 | 97 |
| Ex. 3 | 0.72 | 1.17 | absent | 1430 | 1168 | 98 |
| Ex. 4 | 0.67 | 1.14 | absent | 1426 | 1170 | 97 |
| Ex. 5 | 1.26 | 1.28 | absent | 1430 | 1172 | 99 |
| Ex. 6 | 1.09 | 1.14 | absent | 1429 | 1178 | 95 |
| Ex. 7 | 1.83 | 1.33 | absent | 1425 | 1150 | 97 |
| Ex. 8 | 1.30 | 1.26 | absent | 1432 | 1163 | 95 |
| Ex. 9 | −0.18 | 0.79 | absent | 1427 | 1155 | 95 |
| Ex. 10 | 1.19 | 1.18 | absent | 1419 | 1172 | 97 |
| Comp. Ex. 1 | 3.27 | 1.64 | present | 1432 | 1153 | 86 |
| Comp. Ex. 2 | −1.67 | −0.21 | present | 1429 | 1168 | 79 |
| Comp. Ex. 3 | 1.26 | 1.17 | absent | 1428 | 1129 | 97 |
| Comp. Ex. 4 | −1.03 | 0.34 | present | 1432 | 1156 | 82 |
| Comp. Ex. 5 | 1.62 | 1.32 | absent | 1430 | 1117 | 97 |

From Tables 1 to 3, according to Examples 1 to 10, in which the method for preparing the alloy for R-T-B based rare earth sintered magnet was appropriately controlled, the main phase A was present. The area ratio of the main phase A was 2% or more and 60% or less. As a result, kurtosis and skewness of the fine powder were suitable values. R-T-B based rare earth sintered magnet prepared using the fine powder did not cause abnormal grain growth, and Br, Hcj and Hk/Hcj became preferable.

On the other hand, in Comparative Example 1, in which the high-frequency melting temperature is high and temperature of the alloy slab is also high, the main phase A did not exist in the alloy for R-T-B based rare earth sintered magnet. As a result, skewness of the fine powder was out of preferable range, and abnormal grain growth generated in R-T-B based rare earth sintered magnet after sintering, and Hk/Hcj remarkably decreased.

In Comparative Example 2, in which temperature of the alloy slab is high, the main phase A was not present in the alloy for R-T-B based rare earth sintered magnet. As a result, kurtosis of the fine powder was out of preferable range, and abnormal grain growth generated in R-T-B based rare earth sintered magnet after sintering, and Hk/Hcj remarkably decreased.

In Comparative Example 3, in which temperature of the alloy slab was low and the holding time in the collecting part was long, the main phase A was not present in the alloy for R-T-B based rare earth sintered magnet. As a result, Hcj of R-T-B based rare earth sintered magnet after sintering remarkably decreased.

In Comparative Example 4, in which temperature of the high-frequency melting is high, the main phase A was present in the alloy for R-T-B based rare earth sintered magnet, but the area ratio of the main phase A was excessively low. As a result, skewness of the fine powder was out of preferable range, abnormal grain growth occurred in R-T-B based rare earth sintered magnet after sintering, and Hk/Hcj remarkably decreased.

In Comparative Example 5, in which temperature of the high-frequency melting was low and temperature of the collecting part was high, the main phase A was present in alloy for the R-T-B based rare earth sintered magnet, but area ratio of the main phase A was excessively high. As a result, Hcj of the sintered R-T-B based rare earth sintered magnet remarkably decreased.

REFERENCES OF THE NUMERALS

1 . . . Alloy for R-T-B based rare earth sintered magnet
1*a* . . . Roll contact surface
1*b* . . . open surface
21 . . . Main phase
21*a* . . . Main phase A (specific angle main phase A1)
23 . . . Grain boundary phase
25 . . . Void
61, 63, 65, 71, 73, 75 . . . distribution curve

The invention claimed is:

1. An alloy for an R-T-B based rare earth sintered magnet, where:

R is one or more rare earth elements,

T is one or more transition metal elements comprising Fe or Fe and Co, and

B is boron, the alloy comprising main phases (A), each having a minimum length of 10 μm or more and a maximum length of 30 μm or more and 300 μm or less, in a cross section cut along a thickness direction of the alloy, the main phases (A) comprising an $R_2T_{14}B$ phase, and an area ratio of a total area of all of the main phases (A) to an area of an entirety of the cross section being 2% or more and 60% or less, wherein:

the main phases (A) comprise specific angle main phases (A1) in the cross section, each of the specific angle main phases (A1) is arranged such that a direction of a maximum length of each of the specific angle main phases (A1) is angled with respect to the thickness direction of the alloy by an angle of 0° or more and 45° or less, and an area ratio of a total area of all of the specific angle main phases (A1) to the total area of all of the main phases (A) is 50% or more and 92% or less.

2. The alloy for the R-T-B based rare earth sintered magnet according to claim 1, wherein the alloy comprises a void in the cross section.

3. The alloy for the R-T-B based rare earth sintered magnet according to claim 2, wherein:

the void has a maximum length of 5 μm or more, and an area ratio of the void with respect to the entirety of the cross section cut along a thickness direction of the alloy is larger than 0% and 0.1% or less.

4. The alloy for the R-T-B based rare earth sintered magnet according to claim 1, wherein, in the cross section cut along the thickness direction of the alloy, a void is not included in the main phases (A).

5. The alloy for the R-T-B based rare earth sintered magnet according to claim 1, wherein, in the cross section cut along the thickness direction of the alloy, a void is not included in the main phases (A), but is included in a phase other than the main phases (A).

6. The alloy for the R-T-B based rare earth sintered magnet according to claim 1, wherein, in the cross section cut along the thickness direction of the alloy, a void is not included in the main phases (A) but is included in a phase other than the main phases (A), the void has a maximum length of 5 μm or more, and an area ratio of the void with respect to the entirety of the cross section cut along a thickness direction of the alloy is larger than 0% and 0.1% or less.

7. The alloy for the R-T-B based rare earth sintered magnet according to claim 1, wherein, in the cross section cut along the thickness direction of the alloy, a small void, having a maximum length of less than 5 μm, is included in the main phases (A), and a large void, having a maximum length of 5 μm or more, is not included in the main phases (A).

8. The alloy for the R-T-B based rare earth sintered magnet according to claim 1, wherein, in the cross section cut along the thickness direction of the alloy, a small void, having a maximum length of less than 5 μm, is included in the main phases (A), a large void, having a maximum length of 5 μm or more, is not included in the main phases (A), but is included in a phase other than the main phases (A), and an area ratio of the large void with respect to the entirety of the cross section cut along a thickness direction of the alloy is larger than 0% and 0.1% or less.

9. The alloy for the R-T-B based rare earth sintered magnet according to claim 1, wherein R is Nd or Nd and Pr.

10. The alloy for the R-T-B based rare earth sintered magnet according to claim 1, wherein an R content is 25 mass % or more and 50 mass % or less.

11. The alloy for the R-T-B based rare earth sintered magnet according to claim 1, wherein a B content is 0.5 mass % or more and 2 mass % or less.

12. The alloy for the R-T-B based rare earth sintered magnet according to claim 1, wherein:

T is one or more transition metal elements comprising Fe and Co, and a Co content included as T is 0.5 mass % or more and 60 mass % or less, and a Fe content included as T is a substantial remnant.

13. The alloy for the R-T-B based rare earth sintered magnet according to claim 1, further comprising one or more element selected from the group consisting of Al, Cu, and Zr.

14. A producing method of an R-T-B based rare earth sintered magnet comprising:

pulverizing the alloy for the R-T-B based rare earth sintered magnet according to claim 1 to obtain an R-T-B based rare earth alloy powder, obtaining a R-T-B based rare earth magnet green compact by forming the R-T-B based rare earth alloy powder, and sintering the R-T-B based rare earth magnet green compact.

* * * * *